US008048292B2

(12) United States Patent
Powers et al.

(10) Patent No.: US 8,048,292 B2
(45) Date of Patent: Nov. 1, 2011

(54) SYSTEMS AND METHODS FOR PRODUCING A CRUDE PRODUCT

(75) Inventors: Christopher Alan Powers, Mandeville, LA (US); Bruce Reynolds, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 427 days.

(21) Appl. No.: 12/233,480

(22) Filed: Sep. 18, 2008

(65) Prior Publication Data

US 2009/0057195 A1 Mar. 5, 2009

Related U.S. Application Data

(63) Continuation-in-part of application No. 11/305,378, filed on Dec. 16, 2005, now Pat. No. 7,431,831.

(51) Int. Cl.
*C10G 47/04* (2006.01)

(52) U.S. Cl. ..... 208/108; 208/112

(58) Field of Classification Search ..... None
See application file for complete search history.

(56) References Cited

U.S. PATENT DOCUMENTS 3,775,292 A * 11/1973 Watkins ..... 208/86
3,817,856 A 6/1974 Aaron et al.
4,485,004 A 11/1984 Fisher et al.
4,592,827 A 6/1986 Galiasso et al.
4,684,456 A 8/1987 Van Driesen et al.
4,710,486 A 12/1987 Lopez et al.
4,824,821 A 4/1989 Lopez et al.
4,943,547 A 7/1990 Seamans et al.
4,970,190 A 11/1990 Lopez et al.
5,039,392 A 8/1991 Bearden et al.
5,041,404 A 8/1991 Seamans et al.
5,162,282 A 11/1992 Lopez et al.
5,164,075 A 11/1992 Lopez et al.
5,178,749 A 1/1993 Lopez et al.
5,298,152 A 3/1994 Kramer et al.
5,371,308 A 12/1994 Gosselink et al.
5,374,348 A 12/1994 Sears et al.
5,484,755 A 1/1996 Lopez et al.
5,527,473 A 6/1996 Ackerman
5,871,638 A 2/1999 Pradhan et al.
5,914,010 A 6/1999 Hood et al.
5,925,238 A 7/1999 Duddy et al.
5,935,418 A 8/1999 Chakrabarty et al.
5,954,945 A 9/1999 Cayton et al.
5,977,192 A 11/1999 Howsmon et al.
6,071,402 A 6/2000 Danot et al.
6,139,723 A 10/2000 Pelrine et al.
6,156,693 A 12/2000 Song et al.
6,156,695 A 12/2000 Soled et al.
(Continued)

OTHER PUBLICATIONS

Solvent Deasphalting of Vacuum Residue in a Bench-Scale Unit, Petroleum & Coal 48(3), Nov. 14-19, 2006. Sattarin et al.

*Primary Examiner* — Tam M Nguyen

(57) ABSTRACT

Systems and methods for hydroprocessing a heavy oil feedstock, the system employs a plurality of contacting zones and separation zones and a solvent deasphalting (SDA) unit for providing at least a portion of the heavy oil feedstock. The contacting zones operate under hydrocracking conditions, employing a slurry catalyst for upgrading the deasphalted oil, forming upgraded products of lower boiling hydrocarbons. In the separation zones which operates at a temperature within 20° F. and a pressure within 10 psi of the pressure in the contacting zones, upgraded products are removed overhead and optionally, further treated in an in-line hydrotreater.

26 Claims, 4 Drawing Sheets

U.S. PATENT DOCUMENTS 6,162,350 A 12/2000 Soled et al.
6,190,542 B1 2/2001 Comolli et al.
6,241,874 B1 6/2001 Wallace et al.
6,270,654 B1 8/2001 Colyar et al.
6,274,530 B1 8/2001 Cayton et al.
6,277,895 B1 8/2001 Zhou et al.
6,278,034 B1 8/2001 Espinoza et al.
6,291,391 B1 9/2001 MacArthur et al.
6,299,760 B1 10/2001 Soled et al.
6,451,729 B1 9/2002 Song et al.
6,534,437 B2 3/2003 Eijsbouts et al.
6,554,994 B1 4/2003 Reynolds et al.
6,620,313 B1 9/2003 Demmin et al.
6,630,066 B2 10/2003 Cash et al.
6,635,599 B1 10/2003 Eijsbouts et al.
6,652,738 B2 11/2003 Eijsbouts et al.
6,660,157 B2 12/2003 Que et al.
6,712,955 B1 3/2004 Hou et al.
6,726,832 B1 4/2004 Baldassari et al.
6,758,963 B1 7/2004 Hantzer et al.
7,150,823 B2 12/2006 Mayer et al.
7,179,366 B2 2/2007 Harle et al.
7,214,308 B2 5/2007 Colyar
7,223,713 B2 5/2007 Alonso et al.
7,232,515 B1 6/2007 Demmin et al.
7,297,250 B2 11/2007 Bronicki
7,358,413 B2 4/2008 Stell et al.
7,413,669 B2 8/2008 Gonzalez et al.
7,416,653 B2 8/2008 Wellington et al.
2002/0010088 A1 1/2002 Eijsbouts et al.
2002/0125172 A1 9/2002 Que et al.
2002/0166797 A1 11/2002 Banerjee
2003/0089636 A1 5/2003 Marchionna et al.
2003/0102254 A1 6/2003 Eijsbouts et al.
2003/0150778 A1 8/2003 Haluska et al.
2004/0134837 A1 7/2004 Dassori et al.
2004/0163999 A1 8/2004 Plantega et al.
2004/0226860 A1 11/2004 Bourges et al.
2005/0040080 A1 2/2005 Riley et al.
2005/0145538 A1 7/2005 Wellington et al.
2005/0145543 A1 7/2005 Bhan et al.
2005/0150818 A1 7/2005 Bhan et al.
2005/0155908 A1 7/2005 Bhan et al.
2005/0167320 A1 8/2005 Bhan et al.
2005/0167321 A1 8/2005 Wellington et al.
2005/0167322 A1 8/2005 Wellington et al.
2005/0167323 A1 8/2005 Wellington et al.
2005/0167324 A1 8/2005 Bhan et al.
2005/0167326 A1 8/2005 Bhan et al.
2005/0167327 A1 8/2005 Bhan et al.
2005/0167328 A1 8/2005 Bhan et al.
2005/0167329 A1 8/2005 Bhan et al.
2005/0167330 A1 8/2005 Bhan et al.
2005/0167331 A1 8/2005 Bhan et al.
2005/0167332 A1 8/2005 Bhan et al.
2005/0173298 A1 8/2005 Wellington et al.
2005/0173301 A1 8/2005 Bhan et al.
2005/0173302 A1 8/2005 Bhan et al.
2005/0173303 A1 8/2005 Bhan et al.
2005/0241991 A1 11/2005 Lott et al.
2005/0241992 A1 11/2005 Lott et al.
2005/0241993 A1 11/2005 Lott et al.
2006/0011511 A1 1/2006 Hokari et al.
2006/0054535 A1 3/2006 Chen et al.
2006/0060501 A1 3/2006 Gauthier et al.
2006/0060502 A1 3/2006 Soled et al.
2006/0060503 A1 3/2006 Soled et al.
2006/0157385 A1 7/2006 Montanari et al.
2006/0163115 A1 7/2006 Montanari et al.
2006/0175229 A1 8/2006 Montanari et al.
2006/0186021 A1 8/2006 Marchionna et al.
2006/0201854 A1 9/2006 Lott et al.
2006/0207917 A1 9/2006 Domokos et al.
2006/0231465 A1 10/2006 Bhan et al.
2006/0272982 A1 12/2006 Montanari et al.
2006/0289340 A1 12/2006 Brownscombe et al.
2007/0000808 A1 1/2007 Bhan et al.
2007/0000810 A1 1/2007 Bhan et al.
2007/0012595 A1 1/2007 Brownscombe et al.
2007/0045156 A1 3/2007 Khadzhiev et al.
2007/0084754 A1 4/2007 Soled et al.
2007/0090023 A1 4/2007 Soled et al.
2007/0090024 A1 4/2007 Soled et al.
2007/0158236 A1 7/2007 Zhou et al.
2007/0158238 A1 7/2007 Wu et al.
2007/0161505 A1 7/2007 Pereira-Almao et al.
2007/0238607 A1 10/2007 Alonso et al.
2007/0284285 A1 12/2007 Stepanik et al.
2007/0295641 A1 12/2007 Brownscombe et al.
2007/0295645 A1 12/2007 Brownscombe et al.
2007/0295646 A1 12/2007 Bhan et al.
2007/0295647 A1 12/2007 Brownscombe et al.
2008/0083650 A1 4/2008 Bhan et al.
2008/0083652 A1 4/2008 Morel et al.
2008/0083655 A1 4/2008 Bhan et al.
2008/0085225 A1 4/2008 Bhan et al.
2008/0087575 A1 4/2008 Bhan et al.
2008/0087578 A1 4/2008 Bhan et al.
2008/0099371 A1 5/2008 McCoy et al.

* cited by examiner

SYSTEMS AND METHODS FOR PRODUCING A CRUDE PRODUCT

CROSS-REFERENCE TO RELATED APPLICATIONS

This application is a continuation-in-part of U.S. patent application Ser. No. 11/305,378 having a filing date of Dec. 16, 2005, now U.S. Pat. No. 7,431,831. This application claims priority to and benefits from the foregoing, the disclosure of which is incorporated herein by reference.

TECHNICAL FIELD

The invention relates to systems and methods for treating or upgrading heavy oil feeds, and crude products produced using such systems and methods.

BACKGROUND

The petroleum industry is increasingly turning to heavy oil feeds such as heavy crudes, resids, coals, tar sands, etc. as sources for feedstocks. These feedstocks are characterized by high concentrations of asphaltene rich residues, and low API gravities, with some being as low as less than 0° API.

US Patent Publication No. 2008/0083650, US Patent Publication No. 2005/0241993, US Patent Publication No. 2007/0138057, and U.S. Pat. No. 6,660,157 describe processes, systems, and catalysts for processing heavy oil feeds. SDA units are typically used in refineries to extract incremental lighter hydrocarbons from a heavy hydrocarbon stream, whereby the extracted oil is typically called deasphalted oil (DAO) containing a minimal amount of asphaltenes, while leaving a residue stream behind that is more concentrated in heavy molecules and heteroatoms, typically known as SDA Bottoms, etc. In the prior art, the DAO from a SDA unit associated with an oil refinery is typically returned to the refinery for conversion to gasoline, jet fuel, etc. The SDA Bottoms can be combined with diluent, such as diesel fuel, for conversion to residual fuel.

There is still a need for improved systems and methods to upgrade/treat process heavy oil feeds, having reduced cooking, improved process flow and temperature distribution in the contacting zones as compared to the processes in the prior art.

SUMMARY OF THE INVENTION

In one aspect, this invention relates to a process for by which a heavy oil feedstock can be upgraded. The process employs a plurality of contacting zones, separation zones and a solvent deasphalting unit (SDA) for providing at least a portion of the heavy oil feedstock. The process comprises: a) combining a hydrogen containing gas feed, the a heavy oil feedstock, and a slurry catalyst in a first contacting zone under hydrocracking conditions to convert at least a portion of the heavy oil feedstock to upgraded products, wherein at least a portion of the heavy oil feedstock is from the SDA as deasphalted oil or SDA bottoms; b) sending a mixture of the upgraded products, the slurry catalyst, the hydrogen containing gas, and unconverted heavy oil to a separation zone; c) in the separation zone, removing the upgraded products with the hydrogen containing gas as an overhead stream, and removing the slurry catalyst and the unconverted heavy oil as a non-volatile stream; f) sending the non-volatile stream to another contacting zone, under hydrocracking conditions with additional hydrogen gas to convert the heavy oil to upgraded products; f) sending the upgraded products, the slurry catalyst, hydrogen, and unconverted heavy oil to a separation zone, whereby the upgraded products are removed with hydrogen as an overhead stream and the slurry catalyst and the unconverted heavy oil are removed as a non-volatile stream.

In another aspect, there is provided a process employing a plurality of contacting zones, separation zones and a solvent deasphalting unit (SDA) for treating heavy oil feedstock, wherein the SDA is part of a refinery.

DETAILED DESCRIPTION

Figure 1:
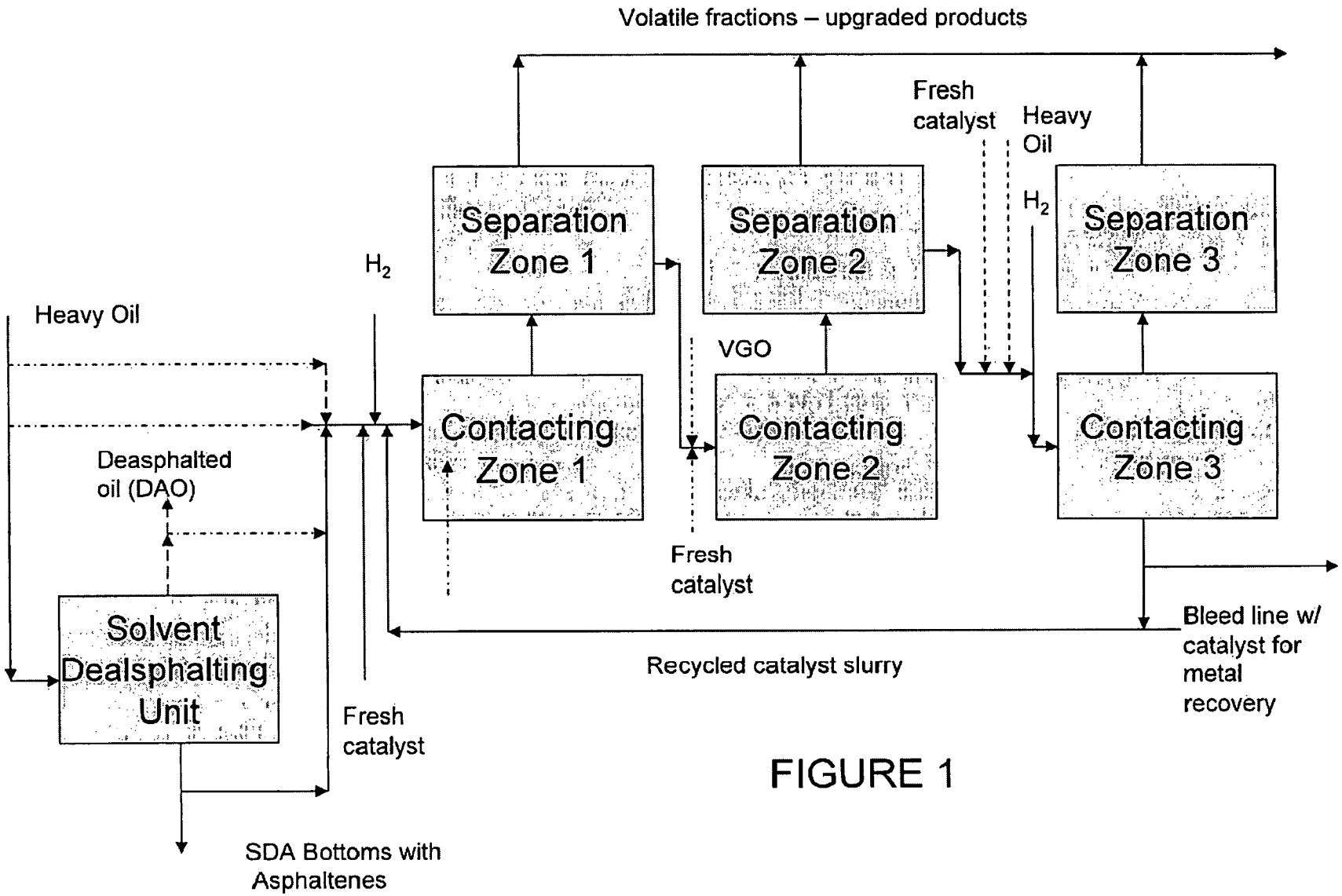
FIG. 1 is a block diagram that schematically illustrates an embodiment of a hydroprocessing system for upgrading a heaving oil feedstock with a plurality of contacting zones and separation zones, wherein the bottoms residue stream from a solvent deasphalting unit provides at least a portion of the heavy oil feedstock.

The present invention relates to a system to treat or upgrade heavy oil feeds which employs with a pre-treatment solvent deasphalting unit (SDA) for reduced coking, improved process flow and temperature distribution in the contacting zone (s).

The following terms will be used throughout the specification and will have the following meanings unless otherwise indicated.

As used herein, "heavy oil" feed or feedstock refers to heavy and ultra-heavy crudes, including but not limited to resids, coals, bitumen, tar sands, etc. Heavy oil feedstock may be liquid, semi-solid, and/or solid. Examples of heavy oil feedstock that might be upgraded as described herein include but are not limited to bottom of the barrel and residuum left over from refinery processes, including "bottom of the barrel" and "residuum" (or "resid")—atmospheric tower bottoms, which have a boiling point of at least 343° C. (650° F.), or vacuum tower bottoms, which have a boiling point of at least 524° C. (975° F.), or "resid pitch" and "vacuum residue"—which have a boiling point of 524° C. (975° F.) or greater. Other examples of heavy oil feedstock include tar sands such as Canada Tar sands, vacuum resid from Brazilian Santos and Campos basins, Egyptian Gulf of Suez, Chad, Venezuelan Zulia, Malaysia, and Indonesia Sumatra.

Properties of heavy oil feedstock may include, but are not limited to: TAN of at least 0.1, at least 0.3, or at least 1; viscosity of at least 10 cSt; API gravity at most 15 in one embodiment, and at most 10 in another embodiment. A gram of heavy oil feedstock typically contains at least 0.0001 grams of Ni/V/Fe; at least 0.005 grams of heteroatoms; at least 0.01 grams of residue; at least 0.04 grams C5 asphaltenes; at least 0.002 grams of MCR; per gram of crude; at least 0.00001 grams of alkali metal salts of one or more organic acids; and at least 0.005 grams of sulfur. In one embodiment, the heavy oil feedstock has a sulfur content of at least 5 wt. % and an API gravity of from −5 to +5. A heavy oil feed comprises Athabasca bitumen (Canada) typically has at least 50% by volume vacuum reside. A Boscan (Venezuela) heavy oil feed may contain at least 64% by volume vacuum residue.

The terms "treatment," "treated," "upgrade", "upgrading" and "upgraded", when used in conjunction with a heavy oil feedstock, describes a heavy oil feedstock that is being or has been subjected to hydroprocessing, or a resulting material or crude product, having a reduction in the molecular weight of the heavy oil feedstock, a reduction in the boiling point range of the heavy oil feedstock, a reduction in the concentration of asphaltenes, a reduction in the concentration of hydrocarbon free radicals, and/or a reduction in the quantity of impurities, such as sulfur, nitrogen, oxygen, halides, and metals.

The upgrade or treatment of heavy oil feeds is generally referred herein as "hydroprocessing." Hydroprocessing is meant any process that is carried out in the presence of hydrogen, including, but not limited to, hydroconversion, hydrocracking, hydrogenation, hydrotreating, hydrodesulfurization, hydrodenitrogenation, hydrodemetallation, hydrodearomatization, hydroisomerization, hydrodewaxing and hydrocracking including selective hydrocracking. The products of hydroprocessing may show improved viscosities, viscosity indices, saturates content, low temperature properties, volatilities and depolarization, etc.

As used herein, hydrogen refers to hydrogen, and/or a compound or compounds that when in the presence of a heavy oil feed and a catalyst react to provide hydrogen.

SCF/BBL (or scf/bbl) refers to a unit of standard cubic foot of gas ($N_2$, $H_2$, etc.) per barrel of hydrocarbon feed.

$Nm^3/m^3$ refers to normal cubic meters of gas per cubic meter of heavy oil feed.

VGO or vacuum gas oil, referring to hydrocarbons with a boiling range distribution between 343° C. (650° F.) and 538° C. (1000° F.) at 0.101 MPa.

As used herein, the term "catalyst precursor" refers to a compound containing one or more catalytically active metals, from which compound a catalyst is eventually formed. It should be noted that a catalyst precursor may be catalytically active as a hydroprocessing catalyst. As used herein, "catalyst precursor" may be referred herein as "catalyst" when used in the context of a catalyst feed.

As used herein, the term "recycled catalyst" refers to a catalyst that has been used in at least a reactor in a hydroprocessing operation and whose activity has thereby been diminished. For example, if a reaction rate constant of a fresh catalyst at a specific temperature is assumed to be 100%, the reaction rate constant for a recycled catalyst temperature is 90% or less in one embodiment, 80% or less in another embodiment, and 70% or less in a third embodiment. The term "recycled" catalyst" may be used interchangeably with "used catalyst," "used slurry catalyst" or "recycled slurry catalyst."

As used herein, the term "fresh catalyst" refers to a catalyst or a catalyst precursor that has not been used in a reactor in a hydroprocessing operation. The term fresh catalyst herein also includes "re-generated" or "rehabilitated" catalysts, i.e., catalyst that been used in at least a reactor in a hydroprocessing operation ("recycled catalyst") but its catalytic activity has been restored or at least increased to a level well above the recycled catalytic activity level. The term "fresh catalyst" may be used interchangeably with "fresh slurry catalyst."

As used herein, the term "slurry catalyst" (or sometimes referred to as "slurry", or "dispersed catalyst") refers to a liquid medium, e.g., oil, water, or mixtures thereof, in which catalyst and/or catalyst precursor particles (particulates or crystallites) having very small average dimensions are dispersed within. In one embodiment, the medium (or diluent) is a hydrocarbon oil diluent. In another embodiment, the liquid medium is the heavy oil feedstock itself. In yet another embodiment, the liquid medium is a hydrocarbon oil other than the heavy oil feedstock, e.g., a VGO medium or diluent.

In one embodiment, the slurry catalyst stream contains a fresh catalyst. In another embodiment, the slurry catalyst stream contains a mixture of at least a fresh catalyst and a recycled catalyst. In a third embodiment, the slurry catalyst stream comprises a recycled catalyst. In another embodiment, the slurry catalyst contains a well-dispersed catalyst precursor composition capable of forming an active catalyst in situ within the feed heaters and/or the contacting zone. The catalyst particles can be introduced into the medium (diluent) as powder in one embodiment, a precursor in another embodiment, or after a pre-treatment step in a third embodiment.

As used herein, the "catalyst feed" includes any catalyst suitable for upgrading heavy oil feed stocks, e.g., one or more bulk catalysts and/or one or more catalysts on a support. The catalyst feed may include at least a fresh catalyst, recycled catalyst only, or mixtures of at least a fresh catalyst and recycled catalyst. In one embodiment, the catalyst feed is in the form of a slurry catalyst.

As used herein, the term "bulk catalyst" may be used interchangeably with "unsupported catalyst," meaning that the catalyst composition is NOT of the conventional catalyst form which has, i.e., having a preformed, shaped catalyst support which is then loaded with metals via impregnation or deposition catalyst. In one embodiment, the bulk catalyst is formed through precipitation. In another embodiment, the bulk catalyst has a binder incorporated into the catalyst composition. In yet another embodiment, the bulk catalyst is formed from metal compounds and without any binder. In a fourth embodiment, the bulk catalyst is a dispersing-type catalyst for use as dispersed catalyst particles in mixture of liquid (e.g., hydrocarbon oil). In one embodiment, the catalyst comprises one or more commercially known catalysts, e.g., Microcat™ from ExxonMobil Corp.

As used herein, the term "contacting zone" refers to an equipment in which the heavy oil feed is treated or upgraded by contact with a slurry catalyst feed in the presence of hydrogen. In a contacting zone, at least a property of the crude feed may be changed or upgraded. The contacting zone can be a reactor, a portion of a reactor, multiple portions of a reactor, or combinations thereof. The term "contacting zone" may be used interchangeably with "reacting zone."

In one embodiment, the upgrade process comprises a plurality of reactors for contacting zones, with the reactors being the same or different in configurations. Examples of reactors that can be used herein include stacked bed reactors, fixed bed reactors, ebullating bed reactors, continuous stirred tank reactors, fluidized bed reactors, spray reactors, liquid/liquid contactors, slurry reactors, liquid recirculation reactors, and combinations thereof. In one embodiment, the reactor is an up-flow reactor. In another embodiment, a down-flow reactor. In one embodiment, the contacting zone refers to at least a slurry-bed hydrocracking reactor in series with at least a fixed bed hydrotreating reactor. In another embodiment, at least one of the contacting zones further comprises an in-line hydrotreater, capable of removing over 70% of the sulfur, over 90% of nitrogen, and over 90% of the heteroatoms in the crude product being processed.

In one embodiment, the contacting zone comprises a plurality of reactors in series, providing a total residence time ranging from 0.1 to 15 hours. In a second embodiment, the resident time ranges from 0.5 to 5 hrs. In a third embodiment, the total residence time in the contacting zone ranges from 0.2 to 2 hours.

As used herein, the term "separation zone" refers to an equipment in which upgraded heavy oil feed from a contacting zone is either fed directly into, or subjected to one or more intermediate processes and then fed directly into the separation zone, e.g., a flash drum or a high pressure separator, wherein gases and volatile liquids are separated from the non-volatile fraction. In one embodiment, the non-volatile fraction stream comprises unconverted heavy oil feed, a small amount of heavier hydrocracked liquid products (synthetic or non-volatile upgraded products), the slurry catalyst and any entrained solids (asphaltenes, coke, etc.). Depending on the conditions of the separation zone, in one embodiment, the amount of heavier hydrocracked products in the non-volatile fraction stream is less than 50 wt. % (of the total weight of the non-volatile stream). In a second embodiment, the amount of heavier hydrocracked products in the non-volatile stream from the separation zone is less than 25 wt. %. In a third embodiment, the amount of heavier hydrocracked products in the non-volatile stream from the separation zone is less than 15 wt. %. It should be noted that at least a portion of the slurry catalyst remains with the upgraded feedstock as the upgraded materials is withdrawn from the contacting zone and fed into the separation zone, and the slurry catalyst continues to be available in the separation zone and exits the separation zone with the non-volatile liquid fraction.

As used herein, the term "separation zone" refers to an equipment in which upgraded heavy oil feed from a contacting zone is either fed directly into, or subjected to one or more intermediate processes and then fed directly into the separation zone, e.g., a flash drum or a high pressure separator, wherein gases and volatile liquids are separated from the non-volatile fraction, e.g., unconverted heavy oil feed, a small amount of heavier hydrocracked liquid products (synthetic or non-volatile or less-volatile liquid fraction), the slurry catalyst and any entrained solids (asphaltenes, coke, etc.). Depending on the conditions of the separation zone, in one embodiment, the amount of synthetic liquid products in the non-volatile fraction stream is less than 50 wt. % (of the total weight of the non-volatile stream). In a second embodiment, the amount of synthetic products in the non-volatile stream from the separation zone is less than 25 wt. %. In a third embodiment, the amount of synthetic products in the non-volatile stream from the separation zone is less than 15 wt. %. It should be noted that at least a portion of the slurry catalyst remains with the upgraded feedstock as the upgraded materials is withdrawn from the contacting zone and fed into the separation zone, and the slurry catalyst continues to be available in the separation zone and exits the separation zone with the heavier hydrocracked liquid products.

In one embodiment, both the contacting zone and the separation zone are combined into one equipment, e.g., a reactor having an internal separator, or a multi-stage reactor-separator. In this type of reactor-separator configuration, the vapor product exits the top of the equipment, and the non-volatile fractions exit the side or bottom of the equipment with the slurry catalyst and entrained solid fraction, if any.

As used herein, the term "bleed stream" or "bleed off stream" refers to a stream containing recycled catalyst, being "bled" or diverted from the hydroprocessing system, helping to prevent or "flush" accumulating metallic sulfides and other unwanted impurities from the upgrade system.

In one embodiment, the bleed off stream comprises non-volatile materials from a separation zone in the system, typically the last separation zone, containing unconverted materials, slurry catalyst, a small amount of heavier hydrocracked products, small amounts of coke, asphaltenes, etc. In another embodiment, the bleed off stream is the bottom stream from an interstage solvent deasphalting unit in the system. In one embodiment wherein the bleed off stream is diverted from the bottom stream of a separation zone, the bleed stream typically ranges from 2 to 15 wt. % of the total heavy oil feedstock to the system. In another embodiment therein the bleed off stream is diverted from the bottom of a deasphalting unit, the bleed off stream ranges from 0.30 to 5 wt. % of the heavy oil feed stock.

In one embodiment, the bleed-off stream contains between 3 to 30 wt. % slurry catalyst. In another embodiment, the slurry catalyst amount ranges from 3 to 20 wt. %. In yet another embodiment, the bleed-off stream contains an amount of slurry catalyst ranging from 1 to 15 wt. %.

SDA Unit: In one embodiment, the SDA unit is already pre-existing as a part of a refinery configuration. In another embodiment, the SDA unit and the process for hydroprocessing/upgrade the heavy oil feedstock are grass-root units. In yet embodiment, the SDA is pre-existing and the upgrade process is a grass-root unit. The SDA can be a separate unit or a unit integrated into the upgrade system.

In some embodiments, the residue stream (bottom resids or SDA Bottoms) from the SDA unit is used as part of the heavy oil feedstock to the contacting zones. In other embodiments, some of the deasphalted oil (DAO) from the SDA units is send to the contacting zones as part of the heavy oil feedstock to be upgraded.

In one embodiment, all of the heavy oil feedstock to be upgraded enters the SDA prior to being sent to the first contacting zone in the system. In another embodiment, only a portion of the heavy oil feedstock enters the SDA for pretreatment/separation, depending on the source and/or properties of the heavy oil feedstock. For example, the heavy oil feedstock to the process may be from various sources, and some of the heavy oil from certain sources may be bottom resids from a SDA unit. In some embodiments, all of the SDA Bottoms from the SDA unit(s) of a refinery is sent to the contacting zones to be upgraded. In other embodiments, at least a portion of the SDA Bottoms from the SDA unit(s) of a refinery is used as part of the heavy oil feedstock to be upgraded.

In the SDA unit, a mixture of hydrocarbon solvent and heavy oil feed is heated to a desired temperature and for a time sufficient to cause dissolution of the heavy oil in the solvent. The quality of the DAO and SDA Bottoms from the SDA unit ("bottoms stream containing asphaltenes") can be varied by adjusting the solvent used and the desired recovery of DAO relative to the feed to the SDA. It should be note that the more DAO oil that is recovered, the poorer the overall quality of the DAO, and the poorer the overall quality of the SDA Bottoms (or SDA Tar). With respect to the solvent selection, typically, as a lighter solvent is used for the SDA, less DAO will be produced, but the quality will be better, whereas if a heavier solvent is used, more DAO will be produced, but the quality will be lower. This is due to, among other factors, the solubility of the asphaltenes and other heavy molecules in the solvent.

In one embodiment, the residence time of the SDA ranges from ½ hr. to 5 hours. In a second embodiment, from 1 to –4 hours. In a third embodiment, from 2 to 3 hours. The temperature at which the SDA operates is a function of the hydrocarbon solvent. The SDA in one embodiment operates from about 50° F. (10° C.) to about 600° F. (315° C.) or higher. In another embodiment when pentane is used as the solvent, the SDA temperature ranges between 169° C. and 196° C., and in one embodiment at 180° C. In one embodiment, the DAO yield is reduced by rising the temperature, this is due to the solvent density reduction with increasing the temperature.

The SDA can operate at atmospheric pressure or higher pressures. In one embodiment, the SDA operates under atmospheric pressure. In one embodiment, the temperature and pressure are maintained such that the asphaltene-containing heavy oil feedstock and the low-boiling solvent remain in liquid phase conditions. In yet another embodiment, certain additives, including lighter oils, aromatic wash oils, inorganic acids, and the like may be added to improve the efficiency of the deasphalting operation. The contacting in the SDA unit may be done in batch mode, as a continuous fluid-fluid countercurrent mode, or by any other method known to the art.

Various hydrocarbon solvents may be used in the SDA, depending on the desired level of deasphalting prior to feeding the contacting zone. As the molecular weight of the solvent increases, the amount of solvent needed decreases but the selectivity for asphaltenes decreases. In one embodiment, the solvent employed is propane for a low yield, but high quality product (low asphaltenes and low and low carbon residue). In another embodiment, the solvent is pentane for a high product yield but low quality DAO (higher asphaltenes level and/or high carbon residue). In one embodiment, the solvent is a mixture of straight and branch chained paraffinic and aromatic solvents ranging from C4 to C10, e.g., butane, iso-butane, n-pentane, iso-pentane, n-heptanes iso-octane, metaxylene, or natural gas condensate, and combinations thereof. In one embodiment, the solvent is hexane. In a second embodiment, it is iso-octane.

In one embodiment, a sufficient amount of the hydrocarbon solvent is added to SDA to give a solvent to heavy oil feed to the SDA (volume) ratio ranging from 2:1 to 40:1. In one embodiment, the solvent to SDA feed ratio is in the range of 3:1 to 15:1. In yet another embodiment, the solvent to feed ratio is in the range of 4:1 to 6:1. The DAO yield ranges from less than 50 wt. % (of the heavy oil feed) to less than 97 wt. % depending on the solvent used, the SDA operating conditions, and the properties of the heavy oil feedstock. In one embodiment, the DAO yield ranges from 40 to 90 wt. %. In another embodiment, from 50 to 85 wt. %.

In one embodiment, the asphaltenes and slurry catalyst (in the SDA feed) are separated from the deasphalted oil as insolubles and recovered through a proper separation device. A suitable separation device comprises gravity or vacuum filtration. In one embodiment, a mixture of deasphalted oil and most of the solvent is discharged at the top of the separation device, and a mixture of asphaltene and the remainder of the solvent is discharged at the bottom of separation device ("SDA Bottoms"). In one embodiment, the amount of asphaltenes recovered through the SDA (and exiting in the SDA Bottoms) ranges from 5 to 50 wt. % of the heavy oil feed, depending on the properties of the oil feed and the operating parameters of the de-asphalting process.

In one embodiment, the stream containing the mixture of deasphalted oil and the solvent is optionally heated in an evaporator column to produce a DAO product stream substantially free of solvent and a solvent stream. In one example, the DAO stream substantially free of solvent flows to a DAO stripper to which an inert gas, preferably steam, is applied. The steam strips the remaining solvent from the DAO, producing a mixture of steam and solvent that flows out the top of the stripper, and DAO product flows out the bottom of the stripper to the one of the contacting zones.

In one embodiment, the DAO product to the contacting zones contains a minimal amount of asphaltenes, e.g. less than 1 wt. %, a CCR of less than 15 wt. %, less than 100 ppm vanadium. In another embodiment, the amount of asphaltenes in the DAO is less than 3000 wppm. In a third embodiment, less than 6000 wppm. In one embodiment, the DAO after treatment is expected to have a heavy metal (vanadium and nickel) reduction ranging from 70-85%, sulfur reduction ranging from 15 to 25%, CCR reduction ranging from 50-75%, and asphaltenes level of less than 0.5%. In one embodiment with the use of pentane as the solvent, the SDA unit removes at least 80% of the heavy metal, at least 20% of sulfur and at least 50% of the CCR. In another embodiment with butane as the solvent, the SDA unit removed up to 90% of the heavy metal and at least 60% of the CCR from the DAO.

The SDA Bottoms from the SDA unit can be heated and processed to produce an asphaltene product stream substantially free of solvent, and a solvent stream. In one example, the SDA Bottoms is sent to an asphaltenes stripper to which an inert gas, e.g., steam, is applied. The steam strips the solvent producing a mixture of stream and solvent flowing out of the top of the stripper column, and asphaltenes product flows out of the bottom. The asphaltene product stream can be sent away for use in some other applications, e.g., metal recovery/separation then being blended to fuel oil, for use in asphalt, etc. In one embodiment, the SDA Bottoms from the SDA unit is sent to one of the contacting zones of the upgrade system.

In one embodiment, the SDA Bottoms has an API ranging from −15 to −1. In another embodiment, the API ranges from −3 to −10. In one embodiment, the SDA Bottoms has a CCR content ranging from 20 to 70% CCR. In another embodiment, the CCR ranges from 30-60%. In a third embodiment, from 35 to 55%. In one embodiment, the SDA Bottoms has a boiling point of >510° C. (>950° F.)

Depending on the operating conditions of the SDA unit, the quality of the heavy oil feedstock to the SDA, the quality of the SDA Bottoms (e.g., % asphaltenes/% CCR, etc.), and the operating conditions of the upgrade system to treat heavy oil feeds (e.g., the type of catalyst used, the conversion rate, etc.), it is within the scope of the invention that the DAO from the SDA unit is sent to a hydrotreater, and the SDA Bottoms is sent to the upgrade system for processing into lighter products. In another embodiment, the DAO from the SDA unit is sent to the upgrade system as part of the at least one of the contacting zones in combination with an untreated heavy oil feed stream. In yet another embodiment, a portion of the SDA Bottoms is sent to the contacting zones for upgrade.

In one embodiment, the SDA Bottoms is sent to at least one of the contacting zones in combination with another hydrocarbon feed such as VGO, LCO, etc. (light cycle oil) in the range of 2-40 wt. % (of the SDA Bottoms), and/or the non-volatile bottom stream from one of the separation zones. In one embodiment, the stream from the SDA unit, either the SDA Bottoms or the DAO, is combined with heavy oil from other sources (not pre-treated by a SDA unit) as heavy oil feedstock to be upgraded. In another embodiment, additional fresh slurry catalyst is added to the SDA Bottoms prior to being fed to the contacting zone. In yet another embodiment, recycled slurry catalyst feed is used instead of/or in addition to a fresh slurry catalyst feed for combining with the output stream from a SDA unit.

Heavy Oil Feed: The unconverted heavy oil feed here herein may comprise one or more different heavy oil feeds from different sources as a single feed stream, or as separate heavy oil feed streams.

In one embodiment, all of the heavy oil feed to the contacting zones is from the SDA unit. In some embodiments of the present invention and depending on the source/quality of the heavy oil feed, at least a portion of the heavy oil feed (to be upgraded) to at least a contacting zone in the system is from a SDA unit, whether it is a pre-treatment SDA unit or an interstage SDA unit.

In one embodiment, "at least a portion" means at least 5% of the heavy oil feed to be upgraded is from the SDA unit. In another embodiment, at least 10% of the heavy oil feed is from a SDA unit, whether it is the DAO or the SDA Bottoms. In a third embodiment, at least 20%. In a fourth embodiment, at least 30% of the heavy oil feed is from a SDA unit.

In one embodiment, the feedstock from the SDA is preheated prior to being blended with the slurry catalyst feed stream(s). In another embodiment, a blend of the feedstock from the SDA, heavy oil feedstock from other sources, and slurry catalyst feed is preheated to create a feedstock that is sufficiently of low viscosity to allow good mixing of the catalyst into the feedstock. In one embodiment, the preheating is conducted at a temperature that is about 100° C. (180° F.) less than the hydrocracking temperature within the contacting zone. In another embodiment, the preheating is at a temperature that is about 50° C. less than the hydrocracking temperature within the contacting zone.

Catalyst Feed: In some embodiments of the present invention, at least a portion of the fresh catalyst is "split" or diverted to at least one other contacting zones in the system (other than the first contacting zone). In one embodiment, "at least a portion" means at least 10% of the fresh catalyst. In another embodiment, at least 20%. In a third embodiment, at least 40%. In a fourth embodiment, at least 60% of the fresh catalyst is diverted to at least a contacting zone other than the first one in the system. In a fifth embodiment, all of the fresh catalyst is diverted to a contacting zone or than the $1^{st}$ contacting zone. In one embodiment, at least a portion of the fresh catalyst feed is sent to the contacting zone immediately following an optional interstage SDA unit. In another embodiment, all of the fresh catalyst is sent to contacting zone(s) other than the $1^{st}$ one in the system, with the first contacting zone only getting DAO from the SDA unit and recycled catalyst from one or more of the processes in the system, e.g., from one of the separation zones in the system.

In one embodiment, the recycled catalyst stream from one of the processes in the system, e.g., a separation zone, etc., is combined with fresh slurry catalyst as one single catalyst feed stream. The combined catalyst feed is thereafter blended with the (treated or untreated) heavy oil feedstock stream(s) for feeding into the contacting zone(s). In another embodiment, the fresh catalyst and the recycled catalyst streams are blended into the heavy oil feedstock stream(s) as separate streams.

In one embodiment, the fresh catalyst is first preconditioned before entering one of the contacting zones, or before being brought into in contact with the heavy oil feed before entering the contacting zones. In one example, the fresh catalyst enters into a preconditioning unit along with hydrogen at a rate from 500 to 7500 SCF/BBL (BBL here refers to the total volume of heavy oil feed to the system), wherein the mixture is heated to a temperature between 400° F. to 1000° F., and under a pressure of 300 to 2500 psi in one embodiment; 500-3000 psi in a second embodiment; and 600-3200 psi in a third embodiment. In another example, the catalyst is preconditioned in hydrogen at a temperature of 500 to 725° F. It is believed that instead of bringing a cold catalyst in contact with the heavy oil feed, the preconditioning step helps with the hydrogen adsorption into the active catalyst sites, and ultimately the conversion rate.

Catalysts Employed: In one embodiment, the catalyst is a multi-metallic catalyst comprising at least a Group VIB metal and optionally, at least a Group VIII metal (as a promoter), wherein the metals may be in elemental form or in the form of a compound of the metal.

In one embodiment, the catalyst is of the formula $(M^t)_a(X^u)_b(S^v)_d(C^w)_e(H^x)_f(O^y)_g(N_z)_h$, wherein M represents at least one group VIB metal, such as Mo, W, etc. or a combination thereof, and X functions as a promoter metal, representing at least one of: a non-noble Group VIII metal such as Ni, Co; a Group VIIIB metal such as Fe; a Group VIB metal such as Cr; a Group IVB metal such as Ti; a Group IIB metal such as Zn, and combinations thereof (X is hereinafter referred to as "Promoter Metal"). Also in the equation, t, u, v, w, x, y, z representing the total charge for each of the component (M, X, S, C, H, O and N, respectively); ta+ub+vd+we+xf+yg+zh=0. The subscripts ratio of b to a has a value of 0 to 5 (0<=b/a<=5). S represents sulfur with the value of the subscript d ranging from (a+0.5b) to (5a+2b). C represents carbon with subscript e having a value of 0 to 11(a+b). H is hydrogen with the value of f ranging from 0 to 7(a+b). O represents oxygen with the value of g ranging from 0 to 5(a+b); and N represents nitrogen with h having a value of 0 to 0.5(a+b). In one embodiment, subscript b has a value of 0, for a single metallic component catalyst, e.g., Mo only catalyst (no promoter).

In one embodiment, the catalyst is a $MoS_2$ catalyst, promoted with at least a group VIII metal compound. In another embodiment, the catalyst is a bulk multimetallic catalyst, wherein said bulk multimetallic catalyst comprises of at least one Group VIII non-noble metal and at least two Group VIB metals and wherein the ratio of said at least two Group VIB metals to said at least one Group VIII non-noble metal is from about 10:1 to about 1:10.

In one embodiment, the catalyst is prepared from a mono-, di, or polynuclear molybdenum oxysulfide dithiocarbamate complex. In a second embodiment, the catalyst is prepared from a molybdenum oxysulfide dithiocarbamate complex.

In one embodiment, the catalyst is prepared from catalyst precursor compositions including organometallic complexes or compounds, e.g., oil soluble compounds or complexes of transition metals and organic acids. Examples of such compounds include naphthenates, pentanedionates, octoates, and acetates of Group VIB and Group VII metals such as Mo, Co, W, etc. such as molybdenum naphthanate, vanadium naphthanate, vanadium octoate, molybdenum hexacarbonyl, and vanadium hexacarbonyl.

In one embodiment, the catalyst feed comprises slurry catalyst having an average particle size of at least 1 micron in a hydrocarbon oil diluent. In another embodiment, the catalyst feed comprises slurry catalyst having an average particle size in the range of 1-20 microns. In a third embodiment, the slurry catalyst has an average particle size in the range of 2-10 microns. In one embodiment, the feed comprises a slurry catalyst having an average particle size ranging from colloidal (nanometer size) to about 1-2 microns. In another embodiment, the catalyst comprises catalyst molecules and/or extremely small particles that are colloidal in size (i.e., less than 100 nm, less than about 10 nm, less than about 5 nm, and less than about 1 nm). In yet another embodiment, the catalyst comprises single layer $MoS_2$ clusters of nanometer sizes, e.g., 5-10 nm on edge.

In one embodiment, the ratio of catalyst to the hydrocarbon oil diluent ranges from 1:1 to 1:500. In another embodiment, the range is about 1:2 to 1:150. In a third embodiment, from 1:5 to 1:100.

In one embodiment, a sufficient amount of fresh catalyst and recycled catalyst is fed to the contacting zone(s) for each contacting zone to have a slurry catalyst concentration ranging from 2 to 30 wt. %. In a second embodiment, the catalyst concentration in the reactor ranges from 3 to 20 wt. %. In a third embodiment, from 5 to 10 wt. %.

In one embodiment, the amount of fresh catalyst feed into the contacting zone(s) range from 50 to 15000 wppm of Mo (concentration in heavy oil feed). In a second embodiment, the concentration of the fresh catalyst feed ranges from 150 to 2000 wppm Mo. In a third embodiment, from 250 to 5000 wppm Mo. In a fourth embodiment, the concentration is less than 10,000 wppm Mo. The concentration of the fresh catalyst into each contacting zone may vary depending on the contacting zone employed in the system, as catalyst may become more concentrated as volatile fractions are removed from a non-volatile resid fraction, thus requiring adjustment of the catalyst concentration.

Process Conditions: The SDA unit is employed in an upgrade process having a plurality of contacting zones, with the process condition being controlled to be more or less uniformly across the contacting zones. In another embodiment, the condition varies between the contacting zones for upgrade products with specific properties.

In one embodiment, the process conditions are maintained under hydrocracking conditions, i.e., at a minimum temperature to effect hydrocracking of a heavy oil feedstock. In one embodiment, at a temperature of 410° C. to 600° C., at a pressure ranging from 10 MPa to 25 MPa.

In one embodiment, the temperature of the separation zone is maintained within ±90° F. (about ±50° C.) of the contacting zone temperature in one embodiment, within ±70° F. (about ±38.9° C.) in a second embodiment, and within ±15° F. (about ±8.3° C.) in a third embodiment, and within ±5° F. (about ±2.8° C.). In one embodiment, the temperature difference between the last separation zone and the immediately preceding contacting zone is within ±50° F. (about ±28° C.).

In one embodiment, the pressure of the separation zone is maintained within ±10 to ±50 psi of the preceding contacting zone in one embodiment, and within ±2 to ±10 psi in a second embodiment.

In one embodiment, the process pressure may range from about 10 MPa (1,450 psi) to about 25 MPa (3,625 psi), about 15 MPa (2,175 psi) to about 20 MPa (2,900 psi), less than 22 MPa (3,190 psi), or more than 14 MPa (2,030 psi).

In one embodiment, the liquid hourly space velocity (LHSV) of the heavy oil feed will generally range from about 0.025 $h^{-1}$ to about 10 $h^{-1}$, about 0.5 $h^{-1}$ to about 7.5 $h^{-1}$, about 0.1 $h.^{-1}$ to about 5 $h^{-1}$, about 0.75 $h^{-1}$ to about 1.5 $h^{-1}$, or about 0.2 $h^{-1}$ to about 10 $h^{-1}$. In some embodiments, LHSV is at least 0.5 $h^{-1}$, at least 1 $h^{-1}$, at least 1.5 $h^{-1}$, or at least 2 $h^{-1}$. In some embodiments, the LHSV ranges from 0.025 to 0.9 $h^{-1}$. In another embodiment, the LHSV ranges from 0.1 to 3 LHSV. In another embodiment, the LHSV is less than 0.5 $h^{-1}$.

Hydrogen Feed: In one embodiment, the hydrogen source is provided to the process at a rate (based on ratio of the gaseous hydrogen source to the crude feed) of 0.1 $Nm^3/m^3$ to about 100,000 $Nm^3/m^3$ (0.563 to 563,380 SCF/bbl), about 0.5 $Nm^3/m^3$ to about 10,000 $Nm^3/m^3$ (2.82 to 56,338 SCF/bbl), about 1 $Nm^3/m^3$ to about 8,000 $Nm^3/m^3$ (5.63 to 45,070 SCF/bbl), about 2 $Nm^3/m^3$ to about 5,000 $Nm^3/m^3$ (11.27 to 28,169 SCF/bbl), about 5 $Nm^3/m^3$ to about 3,000 $Nm^3/m^3$ (28.2 to 16,901 SCF/bbl), or about 10 $Nm^3/m^3$ to about 800 $Nm^3/m^3$ (56.3 to 4,507 SCF/bbl). In one embodiment, some of the hydrogen (25-75%) is supplied to the first contacting zone, and the rest is added as supplemental hydrogen to other contacting zones in system.

In one embodiment, the upgrade system produces a volume yield of least 110% (compared to the heavy oil input) in upgraded products as added hydrogen expands the heavy oil total volume. The upgraded products, i.e., lower boiling hydrocarbons, in one embodiment include liquefied petroleum gas (LPG), gasoline, diesel, vacuum gas oil (VGO), and jet and fuel oils. In a second embodiment, the upgrade system provides a volume yield of at least 115% in the form of LPG, naphtha, jet & fuel oils, and VGO.

In one embodiment of the upgrade system, at least 98 wt % of heavy oil feed is converted to lighter products. In a second embodiment, at least 98.5% of heavy oil feed is converted to lighter products. In a third embodiment, the conversion rate is at least 99%. In a fourth embodiment, the conversion rate is at least 95%. In a fifth embodiment, the conversion rate is at least 80%. As used herein, conversion rate refers to the conversion of heavy oil feedstock to less than 1000° F. (538° C.) boiling point materials.

The hydrogen source, in some embodiments, is combined with carrier gas(es) and recirculated through the contacting zone. Carrier gas may be, for example, nitrogen, helium, and/or argon. The carrier gas may facilitate flow of the crude feed and/or flow of the hydrogen source in the contacting zone(s). The carrier gas may also enhance mixing in the contacting zone(s). In some embodiments, a hydrogen source (for example, hydrogen, methane or ethane) may be used as a carrier gas and recirculated through the contacting zone.

In one embodiment, the hydrogen feed enters the contacting zone co-currently with the heavy oil feed in the same conduit. In another embodiment, the hydrogen source may be added to the contacting zone in a direction that is counter to the flow of the crude feed. In a third embodiment, the hydrogen enters the contacting zone via a gas conduit separately from the combined heavy oil and slurry catalyst feed stream. In a fourth embodiment, the hydrogen feed is introduced directly to the combined catalyst and heavy oil feedstock prior to being introduced into the contacting zone. In yet another embodiment, the hydrogen gas and the combined heavy oil and catalyst feed are introduced at the bottom of the reactor as separate streams. In yet another embodiment, hydrogen gas can be fed to several sections of the contacting zone.

Figures Illustrating Embodiments: Reference will be made to the figures to further illustrate embodiments of the invention. FIG. 1 is a block diagram schematically illustrating a system for upgrading heavy oil feedstock with a SDA unit. The SDA unit can be part of an existing refinery. Although not shown here, besides a deasphalter, the SDA unit also comprises a vapor/liquid separation device (e.g., a flash drum or flash evaporator) and a steam stripper for a DAO product that is substantially free of solvent.

In the SDA unit, the DAO phases are recovered, heated, and steam stripped. In one embodiment, the DAO is sent to a hydrotreater (not shown). In another embodiment, some of the DAO can be sent to the upgrade system (dotted line) as part of the heavy oil feedstock. As illustrated, the SDA bottoms from the SDA unit is introduced into the first contacting zone in the system together with a slurry catalyst feed. The slurry catalyst feed in one embodiment comprises a combination of fresh catalyst and recycled catalyst slurry as separate streams. Hydrogen may be introduced together with the feed in the same conduit, or optionally, as a separate feed stream. Although not shown, additional hydrocarbon oil feed, e.g., VGO, naphtha, in an amount ranging from 2 to 30 wt. % of the heavy oil feed can be optionally added as part of the feed stream to any of the contacting zones in the system.

In the contacting zones under hydrocracking conditions, at least a portion of the heavy oil feedstock (higher boiling point hydrocarbons) is converted to lower boiling hydrocarbons, forming an upgraded product. Upgraded material is sent to a separation zone, e.g., a hot separator, operated at a high temperature and high pressure similar to the contacting zone. The upgraded material may be alternatively introduced into one or more additional hydroprocessing reactors (not shown) for further upgrading prior to going to the hot separator. The separation zone causes or allows the separation of gas and volatile liquids from the non-volatile fractions. The gaseous and volatile liquid fractions are withdrawn from the top of the separation zone for further processing. The non-volatile (or less volatile) fraction is withdrawn from the bottom. Slurry catalyst, some heavier hydrocracked products (synthetic products or less-volatile upgraded products), entrained solids, coke, hydrocarbons newly generated in the hot separator, etc., are withdrawn from the bottom of the separator and fed to the next contacting zone in the series. In one embodiment (not shown), a portion of the non-volatile stream is recycled back to one of the contacting zones preceding the separation zone, in an amount equivalent to 5 to 50 wt. % of the total heavy oil feedstock to the system, providing recycled catalyst for use in the hydroconversion reactions. In another embodiment, the recycled stream is at least 10 wt. % of the total heavy oil feedstock to the system. In yet another embodiment, the recycled stream is 15 to 35 wt. % of the total heavy oil feed.

In one embodiment (as indicated by dotted lines), portions of the fresh catalyst feed, VGO feed, and heavy oil feedstock can be fed directly into the second and third contacting zone as illustrated. Hydrogen may be introduced together with the feed in the same conduit, or optionally, as a separate feed stream. Upgraded materials along with slurry catalyst flow to the next separation zone in series for separation of gas and volatile liquids from the non-volatile fractions. The gaseous and volatile liquid fractions are withdrawn from the top of the separation zone, and combined with the gaseous and volatile liquid fractions from a preceding separation zone for further processing.

The non-volatile (or less volatile) fraction is withdrawn and sent to the next contacting zone 3 in series along with additional hydrogen feed for further upgrading prior to going to the hot separator 3, optionally with additional fresh catalyst feed and heavy oil feedstock. Effluent stream from contacting zone 3 is sent to separation zone 3, where upgraded products are removed overhead, and non-volatile fractions are removed from the bottom stream. A portion of the non-volatile stream is recycled back to the 1$^{st}$ contacting zone, providing the reactor with recycled catalyst. A small amount is removed as a bleed stream, and sent away for metal recovery.

Figure 2:
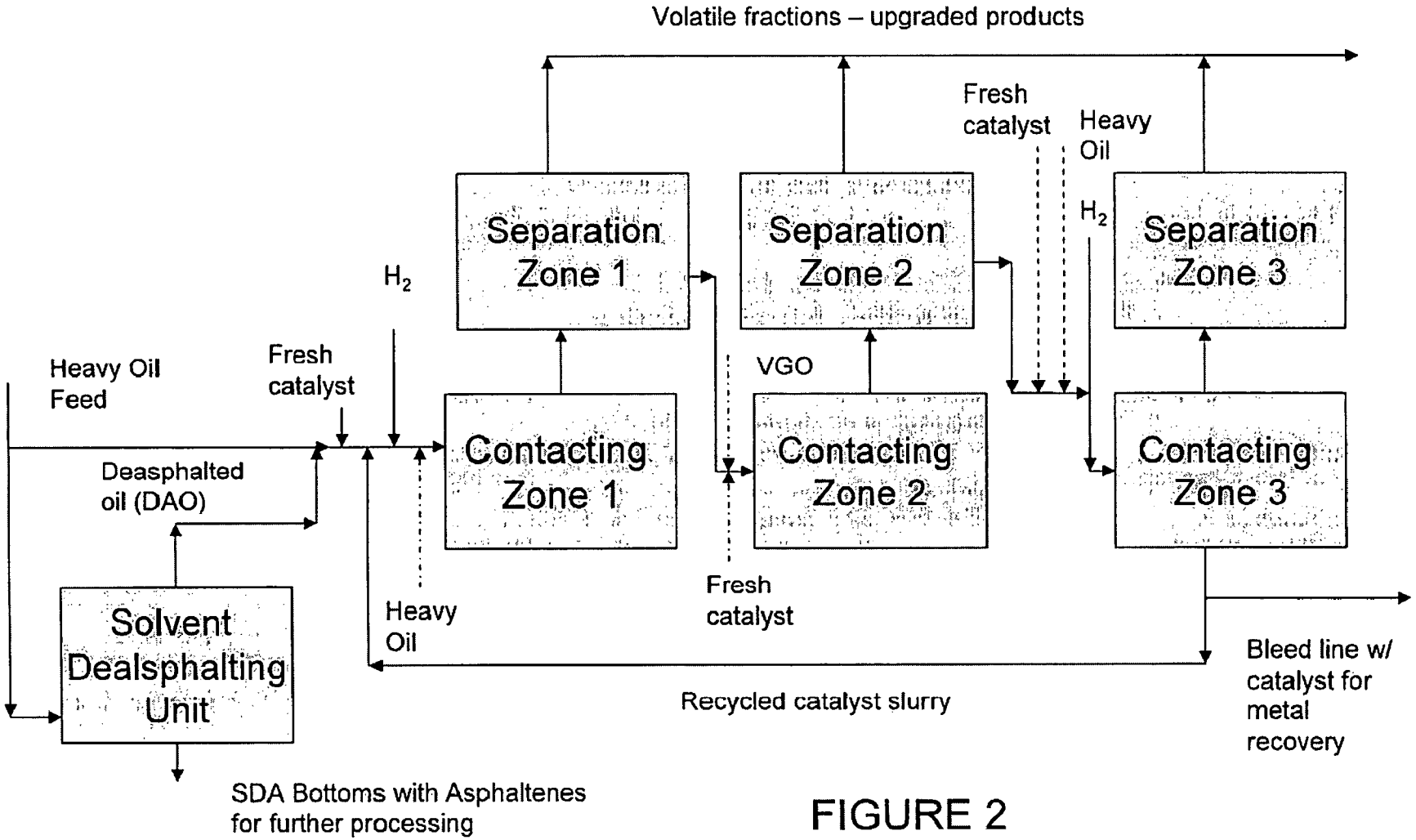
FIG. 2 is a block diagram that schematically illustrates another embodiment of a hydroprocessing system for upgrading a heaving oil feedstock with a pre-treatment solvent deasphalting unit (SDA), wherein a portion of the heavy oil feedstock by-passes the SDA and is sent directly to at least one of the contacting zones and deasphalted oil (DAO) from the SDA is sent to the upgrade system.

FIG. 2 is a block diagram schematically illustrating another embodiment of an upgrade system with a SDA unit. As shown, at least a portion of the heavy oil feedstock is sent to the SDA unit. At least a portion of the heavy oil feedstock by-passes the SDA unit and is sent directly to the contacting zone. In one embodiment, at least 20% of the heavy oil feedstock is sent directly to the contacting zone without SDA treatment. In another embodiment, at least 40%. In a third embodiment, at least 60%. In yet another embodiment, only heavy oil feedstock from certain sources and/or with certain feed characteristics is sent to the SDA for required treatment.

Figure 3:
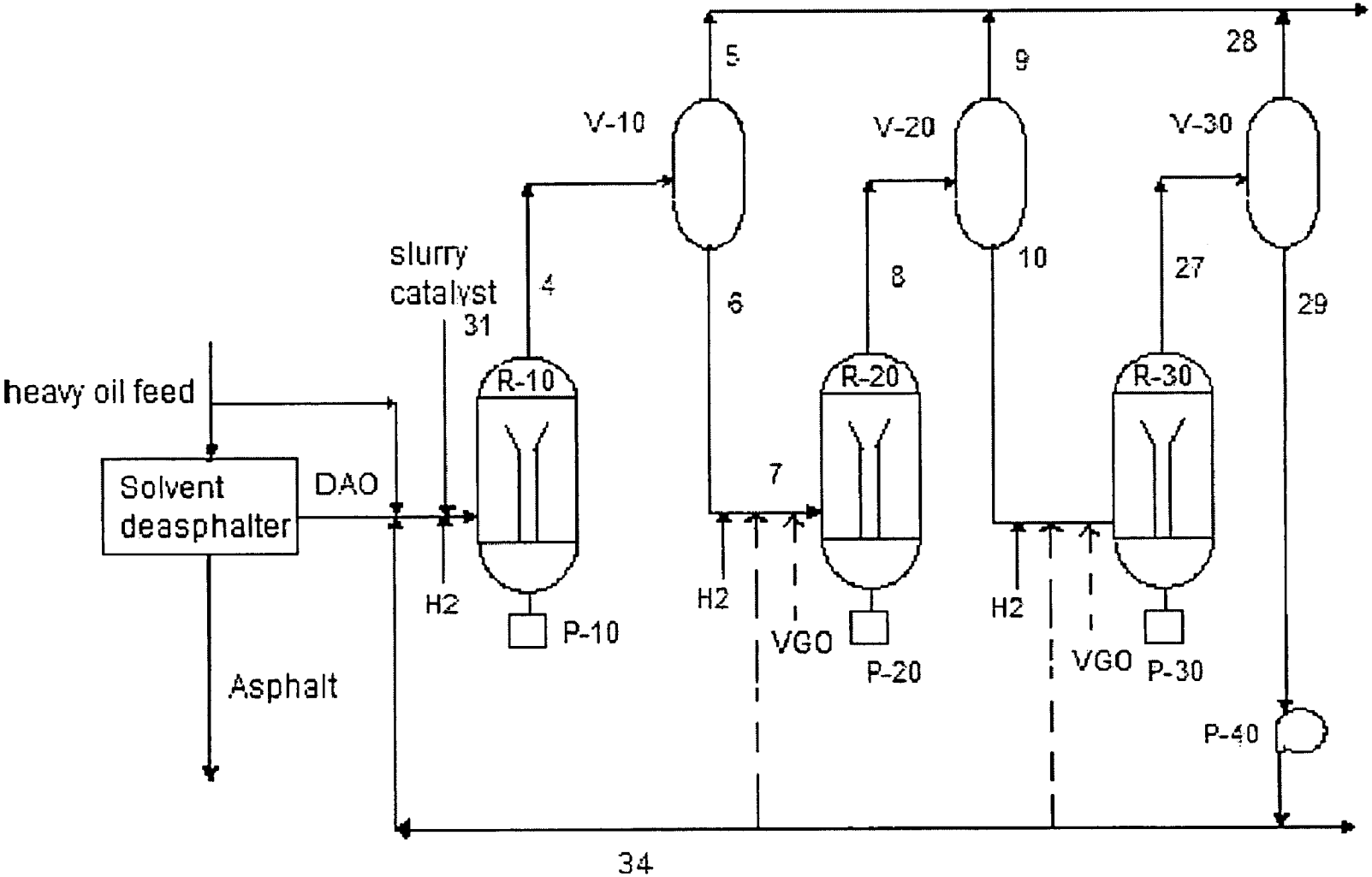
FIG. 3 is a flow diagram of a process to upgrade heavy oil feeds with a pre-treatment solvent deasphalting unit (SDA), wherein deasphalted oil (DAO) from the SDA is used as the feedstock to the upgrade system.

FIG. 3 is a flow diagram of a heavy oil upgrade process with an SDA unit for the removal of asphaltenes from heavy oil feedstock. Also as shown, some of the heavy oil feedstock bypasses the SDA unit and sent directly to the contacting zone for upgrade. DAO product from the SDA unit is combined with fresh catalyst feed 31, the recycle catalyst stream 34, and optionally, a portion of heavy oil feedstock and fed to the first contacting zone as feed along with hydrogen gas. This bypass heavy oil feedstock stream can be varied depending on the quality of the heavy oil feedstock to the system, operating conditions (levels of coke deposit, etc.), desired product quality, amongst other factors.

Although not shown, the DAO and/or the heavy oil feedstock in one embodiment is preheated in furnace before being introduced into the contacting zone as heated feed.

Stream 4 comprising upgraded heavy oil feedstock exits the contacting zone R-10 flows to a separation zone V-10, wherein gases (including hydrogen) and upgraded products in the form of volatile liquids are separated from the non-volatile liquid fraction 6 and removed overhead as stream 5. The non-volatile fraction 6 is sent to the next contacting zone R-20 in series for further upgrade. Stream 6 contains slurry catalyst in combination with unconverted oil, and small amounts of coke and asphaltenes in some embodiments.

The upgrade process continues with the other contacting zones as shown, wherein feed stream 7 to contacting zone R-20 comprises non-volatile fractions, hydrogen feed, optional VGO, and optional fresh catalyst feed. Stream 8 comprising upgraded heavy oil feedstock flows to separation zone V-20, wherein upgraded products are combined with hydrogen and removed as overhead product 9. Bottom stream 10 containing non-volatile fractions, e.g., catalyst slurry, unconverted oil is fed to the next contacting zone in the series R-30.

In one embodiment as shown, fresh catalyst, optional hydrocarbon feed such as VGO (not shown), optional untreated heavy oil feed (not shown), and hydrogen is fed into contacting zone R-30 along with the non-volatile stream from V-20. Upgraded products, unconverted heavy oil, slurry catalyst, hydrogen, etc. are removed overhead as stream 27 and sent to the next separation zone V-30. Overhead stream 28 containing hydrogen and upgraded products is combined with the overhead streams from preceding separation zones, and sent away for subsequent processing in another part of the system, e.g., to a high pressure separator and/or lean oil contactor and/or an in-line hydrotreater (not shown). A portion of the non-volatile stream 29 is recycled back to the first contacting zone as recycled catalyst stream 34, and a portion is sent away for metal recovery as bleed-off stream.

Figure 4:
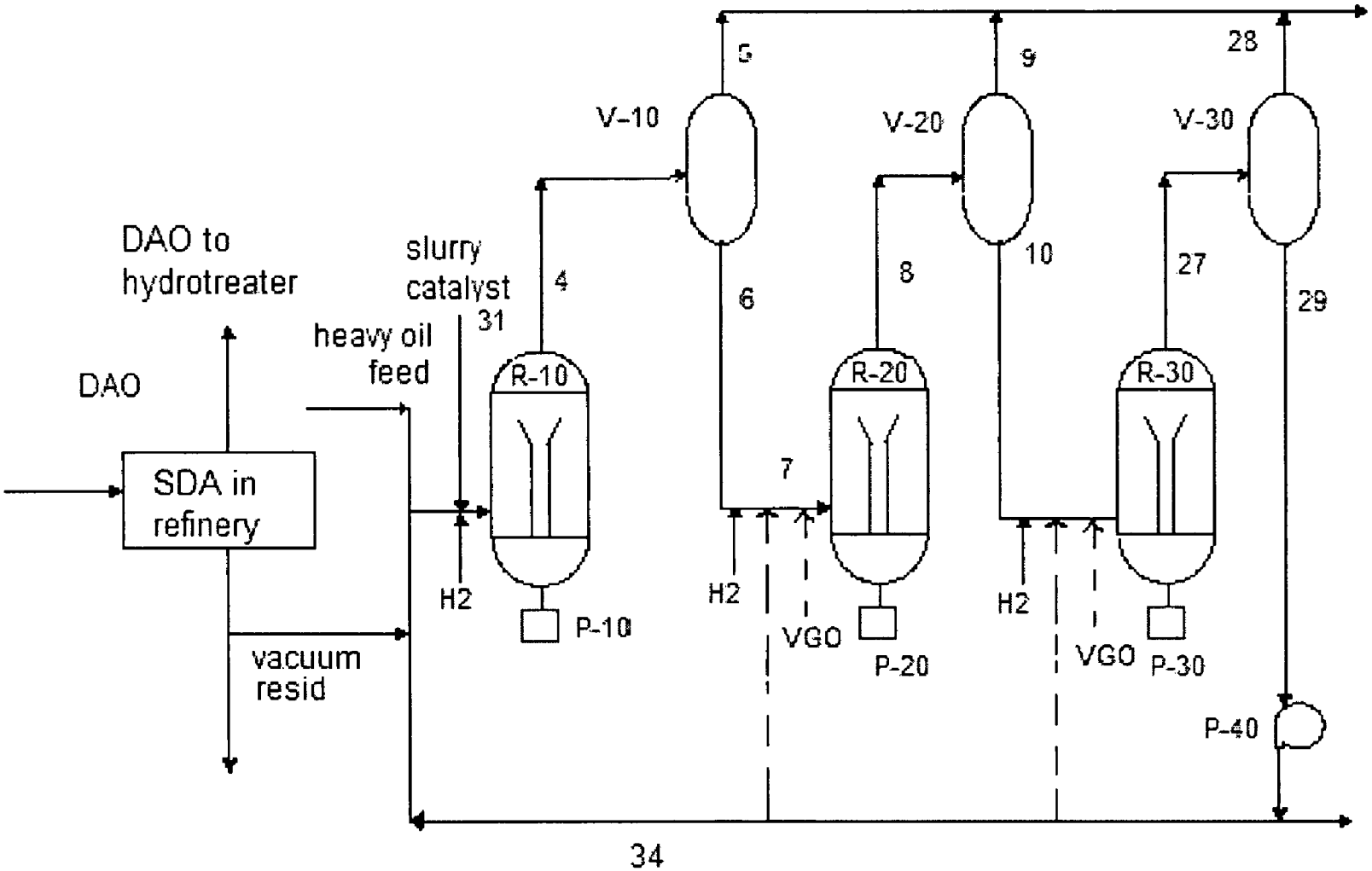
FIG. 4 is a flow diagram of a process to upgrade heavy oil feeds with a pre-treatment solvent deasphalting unit (SDA), and wherein the bottoms residue stream is used as the feedstock to the upgrade system.

FIG. 4 is a variation of the flow diagram of FIG. 3, wherein at least a portion of the heavy oil feedstock to the upgrade process is from a SDA unit, i.e., the SDA Bottoms is used as a part of the heavy oil feedstock. The DAO from the SDA unit is sent to a process such as a hydrotreater.

Although not shown in the figures, the system may further comprise recirculating/recycling channels and pumps for promoting the dispersion of reactants, catalyst, and heavy oil feedstock in the contacting zones, and further help control the temperature in the system. In yet another embodiment (not shown), the system may further comprise an in-line hydrotreater (not shown) for treating the gaseous and volatile liquid fractions from the separation zones. The in-line hydrotreater in one embodiment employs conventional hydrotreating catalysts, is operated at a similarly high pressure (within 10 psig) as the rest of the upgrade system, and capable of removing sulfur, Ni, V, and other impurities from the upgraded products.

In one embodiment, a recirculating pump is employed to circulates a mixture of heavy oil feed and slurry catalyst through the contacting zones as loop reactors, maintaining a temperature difference between the reactor feed point to the exit point ranging from 10 to 50° F., and preferably between 20-40° F.

Depending on the operating conditions, the type of catalyst fed into the contacting zone and the concentration of the slurry catalyst, in one embodiment, the outlet stream from the contacting zones comprises a ratio of 20:80 to 60:40 of upgraded products to unconverted heavy oil feed. In one embodiment, the amount of upgraded products out of the first contacting zone is in the range of 30-35% to unconverted heavy oil product of 65-70%.

The following examples are given as non-limitative illustration of aspects of the present invention.

Example 1

A heavy oil feed having a specific gravity at 15.56° C. of 1.046; 17.2 wt. % asphaltenes; 19.42 wt. CCR; 4.7 wt. % sulfur; 215 ppm vanadium; and 55 ppm nickel is sent to an SDA unit operated at 35° C. and with butane solvent. After treatment, the DAO is anticipated to have less than 0.5 wt. % asphaltenes, a CCR level of less than 7 wt. %; less than 4 wt. % sulfur, less than 20 ppm vanadium and less than 5 ppm nickel.

Example 2

The feed of example 1 is sent to an SDA unit operated at 50° C. and with pentane solvent. The DAO is anticipated to have less than 0.5 wt. % asphaltenes; 10 wt. % CCR, less than 4 wt. % sulfur; less than 30 ppm vanadium; and less than 8 ppm nickel.

Example 3

A heavy oil feed having a specific gravity at 15.56° C. of 1.065; 20 wt. % asphaltenes; 21.45 wt. CCR; 4.88 wt. % sulfur; 265 ppm vanadium; and 73 ppm nickel is sent to an SDA unit operated at 35° C. and with butane solvent. The DAO is anticipated to have less than 0.5 wt. % asphaltenes, a CCR level of less than 7 wt. %; less than 4 wt. % sulfur, less than 20 ppm vanadium and less than 5 ppm nickel.

Example 4

The feed of example 3 is sent to an SDA unit operated at 50° C. and with pentane solvent. The DAO is anticipated to have less than 0.5 wt. % asphaltenes; 12 wt. % CCR, less than 4.5 wt. % sulfur; less than 50 ppm vanadium; and less than 15 ppm nickel.

Comparative Example 4

Heavy oil upgrade experiments can be carried out using a pilot slurry phase hydroprocessing system similar to that shown in FIG. 3, with 3 gas-liquid slurry phase reactors connected in series and a recycling catalyst stream. Each reactor is a continuously stirred reactor type.

The slurry catalyst used can be prepared according to the teaching of US Patent No. 2006/0058174, i.e., a Mo compound is first mixed with aqueous ammonia forming an aqueous Mo compound mixture, sulfided with hydrogen compound, promoted with a Ni compound, then transformed in a hydrocarbon oil (other than heavy oil feedstock) at a temperature of at least 350° F. and a pressure of at least 200 psig, forming an active slurry catalyst. The concentration of the active slurry catalyst in the heavy oil ranges from 2,000 to 5,000 ppm, expressed as weight of metal (molybdenum) to weight of heavy oil feed. The hydroprocessing conditions can be as follows: a reactor temperature of 815-825° F.; a total pressure in the range of 2400 to 2600 psig; a fresh Mo/fresh heavy oil feed ratio (wt. %) 0.20-0.40; fresh Mo catalyst/total Mo catalyst ratio 0.1; total feed LHSV 0.10 to 0.15; and $H_2$ gas rate (SCF/bbl) of 10000 to 15000.

Effluent taken from each reactor is introduced into a hot separator, which separates the effluent into a hot vapor and gaseous stream, which is removed from the top, and a liquid/slurry product stream, which is removed from the bottom.

The feed blend to the reactor can be a blend of two different feed streams, 97% VR and 3% VGO with the following properties:

| | VR | VGO |
|---|---|---|
| API gravity at 60/60 | 3.9 | 15.6 |
| Sulfur (wt %) | 5.58 | 3.28 |
| Nitrogen (ppm) | 5770 | 1177 |
| Nickel (ppm) | 93 | — |
| Vanadium (ppm) | 243 | — |
| Carbon (wt %) | 83.57 | 85.29 |
| Hydrogen (wt %) | 10.04 | 11.01 |
| MCRT - carbon residue (wt %) | 17.2 | 0.04 |
| Viscosity @ 212° F. (cSt) | 3727 | — |
| Pentane Asphaltenes (wt %) | 13.9 | — |
| Fraction Boiling above 1050° F. (wt %) | 81 | 85 |

The product yields, properties and conversion are anticipated to be as follows with middle distillates composing at least 50% of the product: C4-gas (wt %) 12.1; C5-180° F. (wt %) 7.5; hydrocarbon with boiling point (B.P.) 180-350° F. (wt %) 15.5; hydrocarbons with B.P. 350-500° F. (wt %) 20.8; hydrocarbons with B.P. 500-650° F. (wt %) 22.2; hydrocarbons with B.P. 650-800° F. (wt %) 14.8; hydrocarbons with B.P. 800-1000° F. (wt %) 3.9; hydrocarbons with B.P. 1000° F.+(wt %) 0.3; HDN conversion (%) 62; HDS conversion (%) 94; HDM conversion (%) 99; and liquid product API gravity 33.

Example 5

Example 4 is duplicated with a solvent deasphalting unit. In this example, the resid feed is sent to steam-stripping and deasphalting prior to being sent to the 1$^{st}$ reactor of the upgrade system. Different solvents are used, including propane, n-butane and n-pentane, depending on the desired level of asphalting.

In one embodiment of a hydroprocessing unit employing a feed of 20 thousand barrels/day (MBPD) of a heavy oil feed with the properties of 2.5 API, 5 wt. % sulfur (S), 5000 parts per million. by weight (wppm) nitrogen (N), and 20% Conradson carbon residue (CCR), wherein equal volumes of DAO and SDA Bottoms (or SDA Tar) are produced (1:1 ratio), the process condition of the SDA unit is controlled for a DAO of 14.5 API, 3.5 wt. % S, 1500 wppm N, and 8% CCR, and a SDA Bottom of −7.5 API, 6.3 wt. % 5, 8000 wppm N, and 30% CCR. The SDA Bottoms is used as the heavy oil feedstock to the upgrade system of Example 5.

Example 6

Example 5 is duplicated, wherein it is desirable for an output containing a SDA Bottoms (SDA Tar) to DAO volume ratio of 3:1, the condition of the SDA unit is controlled for product qualities to approximate the followings: DAO of 20.1

API, 3.2% S, 1000 wpmm N, and 8% CCR. The SDA Bottoms has: 5.5 wt. % S, 6000 wppm N, 23% CCR, and −2.5 API. The SDA Bottoms is used as the heavy oil feedstock to the upgrade system of Example 5, in place of the VR feed.

Example 7

Example 5 is duplicated, wherein it is desirable for the DAO volume to be 3 times the SDA Bottoms, the SDA condition is controlled such that the product qualities to approximate the followings: DAO of 9.0 API, 3.8 wt. % S, 2000 wppm N, and 8% CCR. The SDA Bottoms has 8.1 wt. % S. 12000 wppm N, 50% CCR, and −13.8 API. The SDA Bottoms is used as the heavy oil feedstock to the upgrade system of Example 5, in place of the VR feed.

For the purpose of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value, thus including the standard deviation of error for the device or method being employed to determine the value. The use of the term "or" in the claims is used to mean "and/or" unless explicitly indicated to refer to alternatives only or the alternative are mutually exclusive, although the disclosure supports a definition that refers to only alternatives and "and/or." The use of the word "a" or "an" when used in conjunction with the term "comprising" in the claims and/or the specification may mean "one," but it is also consistent with the meaning of "one or more," "at least one," and "one or more than one." Furthermore, all ranges disclosed herein are inclusive of the endpoints and are independently combinable. In general, unless otherwise indicated, singular elements may be in the plural and vice versa with no loss of generality. As used herein, the term "include" and its grammatical variants are intended to be non-limiting, such that recitation of items in a list is not to the exclusion of other like items that can be substituted or added to the listed items.

It is contemplated that any aspect of the invention discussed in the context of one embodiment of the invention may be implemented or applied with respect to any other embodiment of the invention. Likewise, any composition of the invention may be the result or may be used in any method or process of the invention. This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A process for hydroprocessing a heavy oil feedstock with a slurry catalyst, the process employing a plurality of contacting zones and separation zones, the process comprising:

combining a heavy oil feedstock, a hydrogen containing gas, and a slurry catalyst in a first contacting zone under hydrocracking conditions to convert at least a portion of the heavy oil feedstock to lower boiling hydrocarbons, forming upgraded products, wherein at least a portion of the heavy oil feedstock comprises a deasphalted oil from a solvent deasphalting unit, the slurry catalyst is unsupported and comprising particles having an average particle size of at least 1 micron in a hydrocarbon oil diluent which is not heavy oil feedstock;

sending a mixture of the upgraded products, the slurry catalyst, the hydrogen containing gas, and unconverted heavy oil feedstock to a separation zone, whereby the upgraded products are removed with the hydrogen containing gas from the separation zone as a first overhead stream, and the slurry catalyst, heavier hydrocracked liquid products, and unconverted heavy oil feedstock are removed from the separation zone as a first non-volatile stream;

sending the first non-volatile stream to a contacting zone other than the first contacting zone, which contacting zone is maintained under hydrocracking conditions with additional hydrogen containing gas to convert at least a portion of the unconverted heavy oil feedstock to lower boiling hydrocarbons, forming additional upgraded products; and sending a mixture of the additional upgraded products, slurry catalyst, additional hydrogen containing gas, and unconverted heavy oil feedstock to a separation zone other than the first separation zone, whereby the upgraded products and additional hydrogen containing gas are removed as a second overhead stream, and the slurry catalyst and unconverted heavy oil are removed as a second non-volatile stream.

2. The process of claim 1, wherein the solvent deasphalting unit is part of a refinery.

3. The process of claim 1, wherein at least 5% of the heavy oil feedstock is deasphalted oil from the solvent deasphalting unit.

4. The process of claim 1, wherein the at least a portion of the heavy oil feedstock from a solvent deasphalting unit comprises a bottoms stream from the solvent deasphalting unit.

5. The process of claim 4, wherein the solvent deasphalting unit is part of a refinery.

6. The process of claim 1, wherein the solvent deasphalting unit and the process for hydroprocessing a heavy oil feedstock are grass-root units.

7. The process of claim 1, wherein the deasphalted oil has less than 1 wt. % asphaltenes, 70 to 85% less heavy metal; 15 to 25% less sulfur, and 50 to 75% less CCR than the heavy oil feedstock level.

8. The process of claim 4, wherein the bottoms stream from the solvent deasphalting unit solvent has an API ranging from −15 to −1, and a CCR content ranging from 5 to 60% CCR.

9. The process of claim 1, wherein all of the heavy oil feedstock is from the solvent deasphalting unit.

10. The process of claim 1, further comprising sending at least a portion of the second non-volatile stream to the first contacting zone as a recycled stream.

11. The process of claim 10, wherein the recycled stream ranges between 5 to 50 wt. % of the heavy oil feedstock.

12. The process of claim 10, wherein the recycled stream ranges between 5 to 35 wt. % of the heavy oil feedstock.

13. The process of claim 10, wherein at least a portion of the second non-volatile stream is removed from the process as a bleed-off stream for the process to have a conversion rate of at least 98.5%.

14. The process of claim 11, wherein the bleed-off stream contains between 3 to 20 wt. % slurry catalyst.

15. The process of claim 1, wherein the contacting zones are maintained under hydrocracking conditions with a temperature of 410° C. to 600° C., and a pressure from 10 MPa to 25 MPa.

16. The process of claim 1, wherein the separation zones are maintained at a temperature within 90° F. of the temperature of the contacting zones, and a pressure within 10 psi of the pressure in the contacting zones.

17. The process of claim 1, wherein the slurry catalyst has an average particle size in the range of 1-20 microns.

18. The process of claim 1, wherein the slurry catalyst comprises clusters of colloidal sized particles of less than 100 nm in size, wherein the clusters have an average particle size in the range of 1-20 microns.

19. The process of claim 1, wherein the process employ a plurality of contacting zones and separation zones, at wherein at least one contacting zone and at least one separation zone are combined into one equipment as a reactor having an internal separator.

20. The process of claim 1, further comprising a plurality of recirculating pumps for promoting dispersion of the heavy oil feedstock and the slurry catalyst in the contacting zones.

21. The process of claim 1, wherein additional hydrocarbon oil feed other than heavy oil feedstock, in an amount ranging from 2 to 30 wt. % of the heavy oil feedstock, is added to any of the contacting zones.

22. The process of claim 1, further comprising an in-line hydrotreater employing hydrotreating catalysts and operating at a pressure within 10 psig of the contacting zones, for removing at least 70% of sulfur, at least 90% of nitrogen, and at least 90% of heteroatoms in the upgraded products.

23. The process of claim 1, for treating a heavy oil feedstock having a TAN of at least 0.1; a viscosity of at least 10 cSt; an API gravity at most 15; at least 0.0001 grams of Ni/V/Fe; at least 0.005 grams of heteroatoms; at least 0.01 grams of residue; at least 0.04 grams C5 asphaltenes; and at least 0.002 grams of MCR.

24. The process of claim 1, wherein at least a portion of the heavy oil feedstock to the process is diverted to a contacting zone other than the first contacting zone, wherein the at least a portion of the diverted heavy oil feedstock, under hydrocracking conditions, is converted to lower boiling hydrocarbons.

25. The process of claim 1, wherein the slurry catalyst feed comprises a recycled slurry catalyst and a fresh slurry catalyst, wherein the fresh slurry catalyst is fed into a contacting zone other than the first contacting zone.

26. The process of claim 25, wherein all of the fresh slurry catalyst is for feeding into contacting zones other than the first contacting zone.

* * * * *